United States Patent [19]

Eblen et al.

[11] 4,162,043

[45] Jul. 24, 1979

[54] FUEL INJECTION NOZZLE

[75] Inventors: Ewald Eblen, Stuttgart; Karl Hofmann, Neckarrems, both of Fed. Rep. of Germany

[73] Assignee: Robert Bosch GmbH, Stuttgart, Fed. Rep. of Germany

[21] Appl. No.: 881,931

[22] Filed: Feb. 28, 1978

[30] Foreign Application Priority Data

Mar. 8, 1977 [DE] Fed. Rep. of Germany ..... 2709892

[51] Int. Cl.[2] ..... F02M 61/04

[52] U.S. Cl. ..... 239/533.3

[58] Field of Search ..... 239/86–96, 239/453, 533.3–533.12

[56] References Cited

U.S. PATENT DOCUMENTS 3,642,212 2/1972 Voit ..... 239/533.4

FOREIGN PATENT DOCUMENTS 512713 2/1955 Italy ..... 239/533.4

*Primary Examiner*—Reeves, Robert B.
*Assistant Examiner*—Andres Kashnikow
*Attorney, Agent, or Firm*—Edwin E. Greigg

[57] ABSTRACT

A fuel injection nozzle in which the needle valve has been improved so that all similarly constructed nozzles will exhibit exactly the same flow cross section with a fully opened valve, and so that, with a constant injection pressure, the fuel quantity injected will not vary between the various nozzles serving the engine. The needle valve is provided with a cyclindrical section, which together with an edge region of the nozzle body defines the narrowest flow cross section obtainable with a spray-forming portion of the needle valve at a fully opened position of the needle valve.

3 Claims, 2 Drawing Figures

FUEL INJECTION NOZZLE

BACKGROUND OF THE INVENTION

The invention relates to a fuel injection nozzle for insertion in internal combustion engines and includes a valve needle having a throttle pin arranged downstream of a sealing cone as well as a subsequent integral spray-forming pin of a smaller diameter. Valve needles of this type are opened in opposition to the flow direction of the fuel and against a closing force. A nozzle body which receives the valve needle has a central cylindrical injection port arrranged to receive the pin and further includes a conical area that preferably serves as a valve seat. Also, in nozzles of this design, the conical area communicates with the injection port and the throttle pin, during a full needle stroke, is adapted to merge from the cylindrical injection port, whereas the spray-forming pin is still extended into the port.

In conventional fuel injection nozzles of this type, the narrowest flow cross section with a fully opened valve differs in the individual nozzles. However, since, on the other hand, the injection pressure effected by the injection pump is constant, this leads to quantity fluctuations of the fuel to be injected at the individual nozzles. The quality of adjustment of the fuel injection pump as well as of the nozzles is naturally dependent on the extent of quantity fluctuation of the individual nozzles installed in an engine.

OBJECT AND SUMMARY OF THE INVENTION

Accordingly, the principal object of this invention is to provide a fuel injection nozzle construction in which the spray-forming pin has an integral cylindrical section of a larger diameter which is located in opposition to an edge formed by the juncture of an injection port and the upstream cone-shaped area and thus determines together with this edge the narrowest flow cross section. In the aforesaid type of fuel injection nozzle construction all nozzles exhibit exactly the same flow cross section with a fully opened valve. In this way the adjustment of the fuel injection pump, as well as of the spring forces at the individual nozzles, can be optimized in accordance with this narrowest cross section. As a consequence, an essential improvement of the fuel consumption, of the exhaust gas, and of the engine efficiency is attained.

Another object of this invention is to provide the spray-forming pin with a tapered terminal portion.

Still another object of this invention is to provide a nozzle needle design in which the ratio of the diameter to the length of the cylindrical section of the needle is 2:10.

Other objects and advantages of the present invention will be more readily apparent from a further consideration of the following detailed description of the drawings illustrating a preferred embodiment of the invention, in which:

DESCRIPTION OF THE PREFERRED EMBODIMENT

Figure 1:
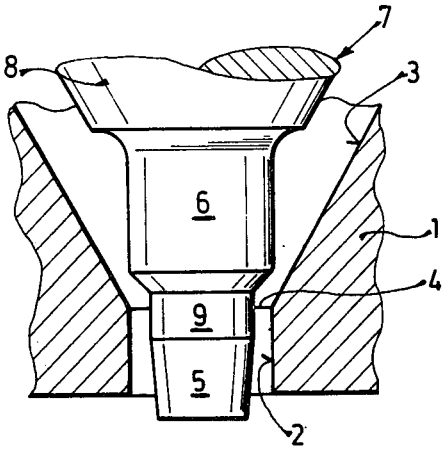
FIG. 1 shows a partial section through a fuel injection nozzle in the zone of the injection port.

In the longitudinal section shown in FIG. 1 as seen through the lower part of a fuel injection nozzle containing the injection port, a cylindrical injection port 2 as well as a conical valve seat 3 are arranged in a nozzle body 1. The valve seat 3 and the bore 2 intersect to form an edge 4. A spray-forming pin 5 extends into the cylindrical injection port 2. This spray-forming pin is arranged at the extremity of a throttle pin 6 of a needle valve 7 which further includes a sealing cone 8 which cooperates with the valve seat 3 in the usual manner. The valve needle, in the illustrated position, contacts a stop, not shown, when the fuel injection nozzle is fully opened. In the closed condition, the sealing cone 8 rests against the valve seat 3 and the throttle pin 6 extends into the cylindrical injection port 2. As soon as the fuel fed by the fuel injection pump, not shown, lifts the valve needle 7 off the seat 3, the fuel passes by way of an annular gap formed between the throttle pin 6 and the circular injection port 2 into the combustion chamber. With an increasing feed quantity and with an increasing conveying pressure, the needle valve 7 is then displaced further into the illustrated position.

The spray-forming pin 5 includes, according to this invention, a cylindrical section 9. The cylindrical section 9, as shown, is located adjacent to the juncture of the conical wall 3 and the cylindrical injection port 2, as indicated by line 4, when the valve is fully opened and thereby defines therewith the maximum flow cross section.

It is relatively easy to provide valve needles with such cylindrical sections, which have absolutely the same diameter. It is likewise relatively easy to provide the cylindrical injection ports 2 in the individual valves with absolutely the same diameter. As a consequence, it is also readily possible to obtain, in a series of fuel injection nozzles of the afore-described type, a narrowest flow cross section which is absolutely identical with the valve being fully open. Correspondingly, in such a case, only very small fluctuations of the thus-injected amount occur from one nozzle to the next, with the same conveying pressure.

Figure 2:
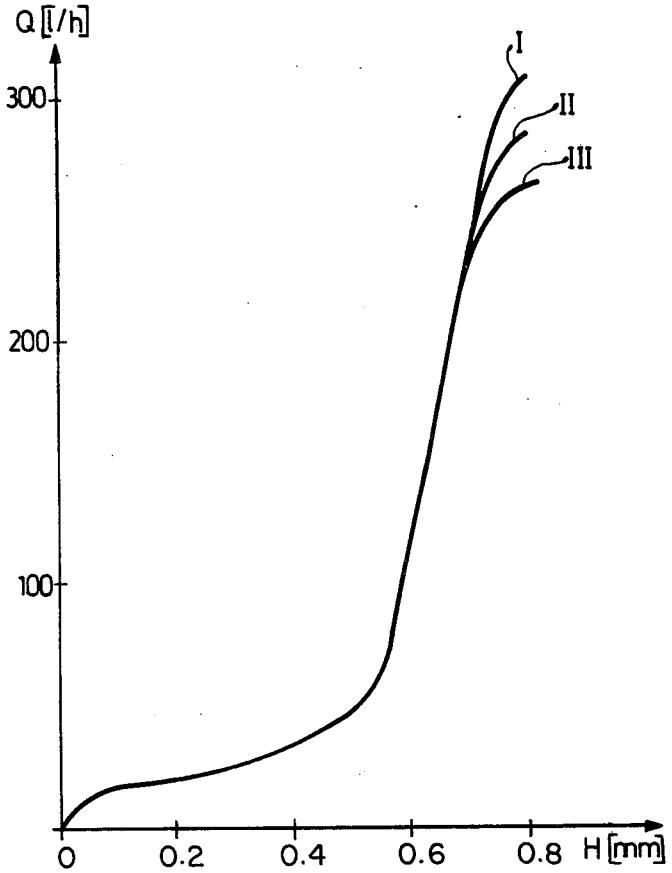
FIG. 2 shows a diagram of the stroke-opening cross section ratio and a comparison between the nozzle of the present invention with a conventional nozzle.

FIG. 2 shows in a diagrammatic form the extent to which a fluctuation makes itself felt as a quantity difference in the narrowest cross section with the same stroke and pressure. In this diagram, the throughflow quantity Q is plotted over the ordinate and the valve needle stroke H over the abscissa. A customary throttle pin nozzle is chosen as the example. As demonstrated by the curve in the diagram, the deviation from nozzle to nozzle is almost immeasurable in case of smaller feed quantities and minor strokes. This can readily be understood, since in this zone the throttle pin still extends into the cylindrical injection port. Only when the throttle pin emerges from the injection port, and only the spray-forming pin is still located therein, do the curves for the individual nozzles deviate from one another. The corresponding branches of the curve have been denoted by I, II and III. With a maximum stroke of the valve needle of, for example, 0.8 mm., the consequence is a fluctuation in the throughflow quantity of respectively 25–30 liters per hour (l./h.). By means of this invention, this fluctuation value can be substantially reduced, for example to below 10 l./h.

According to the invention, it is, of course, also possible to provide, in place of a smooth, cylindrical collar at the spray-forming pin, a set of beveled surfaces thereat, but in this case such beveled surfaces should be the same in all nozzles utilized in a particular engine.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In a fuel injection nozzle for internal combustion engines including a nozzle body and a needle valve, said nozzle body having a central, cylindrical surface defining an injection port and a conical surface serving as a valve seat, said central, cylindrical surface and said conical surface merging to form a dividing edge, said needle valve having a sealing cone portion, a cylindrical throttle pin portion downstream thereof and extending into said injection port when the needle is in the closed condition and a spray-forming pin portion downstream of said throttle pin portion, the diameter of said spray-forming portion being less than the diameter of said throttle pin portion, said needle valve being displaceable in the nozzle body by the fuel pressure in a direction opposite to the direction of fuel flow and against a closing force between a closed position where the sealing cone portion engages the conical surface and a fully opened position, the improvement in the needle valve, comprising:

a cylindrical section forming part of the spray-forming pin portion and situated immediately adjacent to and downstream of said throttle pin portion, and wherein the cylindrical section and the dividing edge are in opposition when the needle valve is in its fully opened position, and together define the narrowest flow cross section obtainable with the spray-forming pin portion.

2. The fuel injection nozzle as defined in claim 1, wherein the spray-forming pin portion includes a tapering, conical section downstream of said cylindrical section.

3. The fuel injection nozzle as defined in claim 1, wherein the ratio of the diameter to the length of the cylindrical section is 2:10.

* * * * *